United States Patent [19]

Pahade

[11] 4,416,677

[45] Nov. 22, 1983

[54] SPLIT SHELF VAPOR AIR SEPARATION PROCESS

[75] Inventor: Ravindra F. Pahade, North Tonawanda, N.Y.

[73] Assignee: Union Carbide Corporation, Danbury, Conn.

[21] Appl. No.: 381,844

[22] Filed: May 25, 1982

[51] Int. Cl.[3] ..... F25J 5/00

[52] U.S. Cl. ..... 62/13; 62/24; 62/28; 62/29; 62/31; 62/34; 62/39

[58] Field of Search ..... 62/11, 12, 23, 24, 27, 62/28, 29, 31, 32, 33, 34, 38, 39, 42, 43, 44

[56] References Cited

U.S. PATENT DOCUMENTS

| | | | |
|---|---|---|---|
| 2,762,208 | 9/1956 | Dennis | 62/122 |
| 2,785,548 | 3/1957 | Becker | 62/175.5 |
| 3,216,206 | 11/1965 | Kessler | 62/13 |
| 3,319,427 | 5/1967 | Cimler et al. | 62/13 |
| 3,340,697 | 9/1967 | Cimler et al. | 62/13 |
| 3,375,673 | 4/1968 | Cimler et al. | 62/13 |
| 3,605,422 | 9/1971 | Pryor et al. | 62/13 |
| 3,947,259 | 3/1976 | Frischbier | 62/13 |

*Primary Examiner*—Frank Sever
*Attorney, Agent, or Firm*—Stanley Ktorides

[57] ABSTRACT

An air separation process wherein shelf vapor is employed for reversing heat exchanger cold end temperature control and is subsequently divided into two streams, one of which is expanded to provide plant refrigeration and the other is recovered as high pressure nitrogen-rich gas.

13 Claims, 2 Drawing Figures

SPLIT SHELF VAPOR AIR SEPARATION PROCESS

TECHNICAL FIELD

This invention relates generally to the field of cryogenic air separation by rectification and more particularly to cryogenic air separation by rectification wherein a portion of high-pressure nitrogen-rich shelf vapor is used to cool incoming air in a reversing heat exchanger prior to expansion to generate refrigeration.

BACKGROUND ART

An often used procedure in the cryogenic air separation art is the use of reversing heat exchangers to clean and cool the incoming feed air. In this procedure incoming feed is cooled by indirect heat exchange with one or more outgoing product or waste streams and simultaneously high boiling impurities in the feed, such as water and carbon dioxide, are deposited onto the heat exchanger walls. Before the solid deposits foul the heat exchanger, the feed air stream is switched to a second passageway of the heat exchanger and a waste stream or a product stream which can accomodate the impurities is passed through the passageway containing the deposits, causing these impurities to vaporize and be carried out with this sweep stream. The procedure is repeated when the second passageway has significant deposits on its walls and so on back and forth so that incoming feed air is constantly being cooled and cleaned and the heat exchanger also cleaned of the deposited impurities.

The amount of impurities that the sweep stream can remove from the heat exchanger is dependent on the sweep stream flow rate, pressure level, and temperature relative to the air feed conditions. Since the sweep stream flow rate and pressure are usually set by clean and dry product requirements and separation column pressure levels, the sweep stream temperature relative to the feed air temperature is generally used as the control parameter.

In order to insure that the reversing heat exchanger be self-cleaning as described above it is important that the cold-end temperature differential between the feed stream and the sweep stream be small. Typically, the cold-end temperature difference should be between 0.5 to 2° K. One often used method of attaining this small temperature differential is to pass a stream partially through the heat exchanger thus warming this stream by indirect heat exchange with the feed. This stream, often termed the reversing heat exchanger unbalance stream, is removed from the heat exchanger before it can completely traverse the heat exchanger. This warmed unbalance stream may then be expanded so as to generate refrigeration which is used in the cryogenic air separation plant. One source of the unbalance stream and subsequently expanded stream is the nitrogen-rich vapor from a high pressure cryogenic air separation column. Such vapor is often termed the shelf vapor because historically a shelf was placed near the top of a column to catch reflux liquid. The liquid at this point was often called the shelf liquid and the vapor at this point was often called the shelf vapor.

In small or medium size cryogenic air separation plants the flow requirement for sufficient reversing heat exchanger temperature control is essentially equivalent to the flow requirement for plant refrigeration and therefore the entire warmed unbalance stream is passed through an expander. However for large cryogenic air separation plants, such as those which supply oxygen for coal conversion plants, the flow requirement for reversing heat exchanger temperature control exceeds the requirement for plant refrigeration. This mismatch becomes quite apparent in a plant designed to produce about 1500 tons per day of oxygen although the mismatch can occur at plant sizes as low as 1000 tons per day of oxygen or less depending on how well the plant is insulated.

The mismatch occurs because the flow requirement for reversing heat exchanger temperature control is independent of plant capacity. It is instead dependent on the degree of warming which is required as the stream partially traverses the reversing heat exchanger. That is, the reversing heat exchanger unbalance stream flow requirement for any given unbalance stream temperature increase is a relatively constant percentage of the feed air flow. As the absolute feed air flow increases the absolute unbalance stream flow also increases but the relationship between the two remains essentially constant. The lesser the unbalance stream is warmed the greater is the flow requirement as a percentage of feed air flow and conversely the greater the unbalance stream is warmed the lesser is the flow requirement as a percentage of feed air flow.

However the plant refrigeration requirement is not independent of plant capacity. There are essentially three causes of cold loss in cryogenic plants. Two of these, the net heat input at the warm end of the reversing heat exchanger due to the requirement of temperature differences for heat exchange between incoming feed air and outgoing return streams, and, cold loss related to the loss from the system of liquid water in the operation of the reversing heat exchanger which entered the system as water vapor, vary directly with the incoming feed air flow rate and thus the flow rate of the stream required to generate refrigeration to compensate for these cold losses remains relatively constant as a percentage of the feed air flow. However the third source of cold loss, heat leak into the cryogenic plant from the ambient air, is a function of the surface area of the cryogenic equipment. As is well known the surface area of vessels or conduits generally increases at less than a one to one relationship with the increase in its capacity. Thus cold loss due to heat leak into a cryogenic air separation plant from the ambient air is a smaller amount relative to feed air flow as plant size increases. Thus the flow requirement for plant refrigeration as a percentage of incoming air flow decreases as the plant capacity increases. With the flow requirement as a percentage of incoming feed air flow for the reversing heat exchanger unbalance stream remaining constant as plant capacity increases, the flow mismatch between the unbalance stream requirement and plant refrigeration requirement manifests itself. All other things being equal, the greater is the plant capacity the greater is the flow mismatch. Although one could expand the entire unbalance stream for a large gas plant and thereby generate excess plant refrigeration, this introduces a thermodynamic inefficiency into the system because that exessive refrigeration would have to be degraded needlessely, as for example, by excessive warm end heat exchanger temperature differences.

The above-described mismatch is recognized in the art. One solution disclosed in U.S. Pat. No. 3,947,259-Frischbier divides the warmed unbalance stream and expands only that portion which is required for plant refrigeration. The other portion is liquified, subcooled, expanded and introduced into a low pressure column. This process is disadvantageous because it requires a two-section main condenser with its attendant complexity.

As previously mentioned one important use of large capacity cryogenic air separation plants is to supply process gases to coal conversion plants. Often such plants require, in addition to oxygen, some high pressure nitrogen, as for example, for inert gas blanketing of equipment. Therefore it would be desirable to have a cryogenic air separation process which would solve the large plant flow mismatch problem described above and also efficiently provide high pressure nitrogen.

It is therefore an object of this invention to provide an improved cryogenic air separation process.

It is another object of this invention to provide an improved cryogenic air separation process which eliminates the flow mismatch between unbalance stream and plant refrigeration requirements in large plants while avoiding complex mechanical requirements.

It is a further object of this invention to provide an improved cryogenic air separation process which eliminates the flow mismatch between unbalance stream and plant refrigeration requirements in large plants while also efficiently producing high pressure nitrogen.

SUMMARY OF THE DISCLOSURE

The above and other objects which will become apparent to those skilled in the art upon a reading of this disclosure are attained:

in a process for the separation of air by rectification wherein gaseous feed air at greater than atmospheric pressure and substantially free of water and carbon dioxide is introduced into a high pressure column operating at a pressure of from about 80 to 180 psia where said feed air is separated by rectification into a nitrogen-rich fraction and an oxygen-enriched fraction, and wherein a portion of said nitrogen-rich fraction is removed from said high pressure column and warmed by indirect heat exchange with said feed air by partial traverse of a reversing heat exchange zone, said portion being sufficient to maintain self-cleaning of the reversing heat exchange zone, the improvement comprising:

(A) warming said portion comprising from about 10 to 18 percent of the feed air flow;

(B) dividing the warmed portion into a first part comprising from about 50 to 90 percent of said warmed portion and a second part comprising from about 10 to 50 percent of said warmed portion;

(C) expanding said first part to a pressure of from about 15 to 35 psia;

(D) warming the expanded first part by passage through said reversing heat exchange zone;

(E) removing from said process said first part as nitrogen-rich gas; and (F) recovering said second part as high pressure nitrogen-rich gas.

The term "indirect heat exchange", as used in the present specification and claims, means the bringing of two fluid streams into heat exchange relation without any physical contact or intermixing of the streams with each other.

The term, "column", as used in the present specification and claims, mean a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemicals Engineers' Handbook, Fifth Edition, edited by R. H. Perry and C. H. Chilton, McGraw-Hill Book Company, New York Section 13, "Distillation" B. D. Smith et al, page 13-3, *The Continuous Distillation Process.* The term, double column, is used to mean a high pressure column having its upper end in heat exchange relation with the lower end of a low pressure column. A further discussion of double columns appears in Ruheman "The Separation of Gases" Oxford University Press, 1949, chapter VII, Commercial Air Separation.

The terms, "reversing heat exchanger" or "reversing heat exchange zone", as used in the present specification and claims, mean an air desuperheater associated with a cryogenic air separation process whereby periodic reversal of the incoming air feed heat exchanger pass with another return sweep stream heat exchanger pass is used to clean the feed air stream from high boiling impurities such as water vapor and carbon dioxide.

The term, "self-cleaning", as used in the present specification and claims, means the removal from a reversing heat exchanger of substantially all of the high boiling impurities removed from the air.

DETAILED DESCRIPTION

The process of this invention will be described in detail with reference to the drawings.

Figure 1:
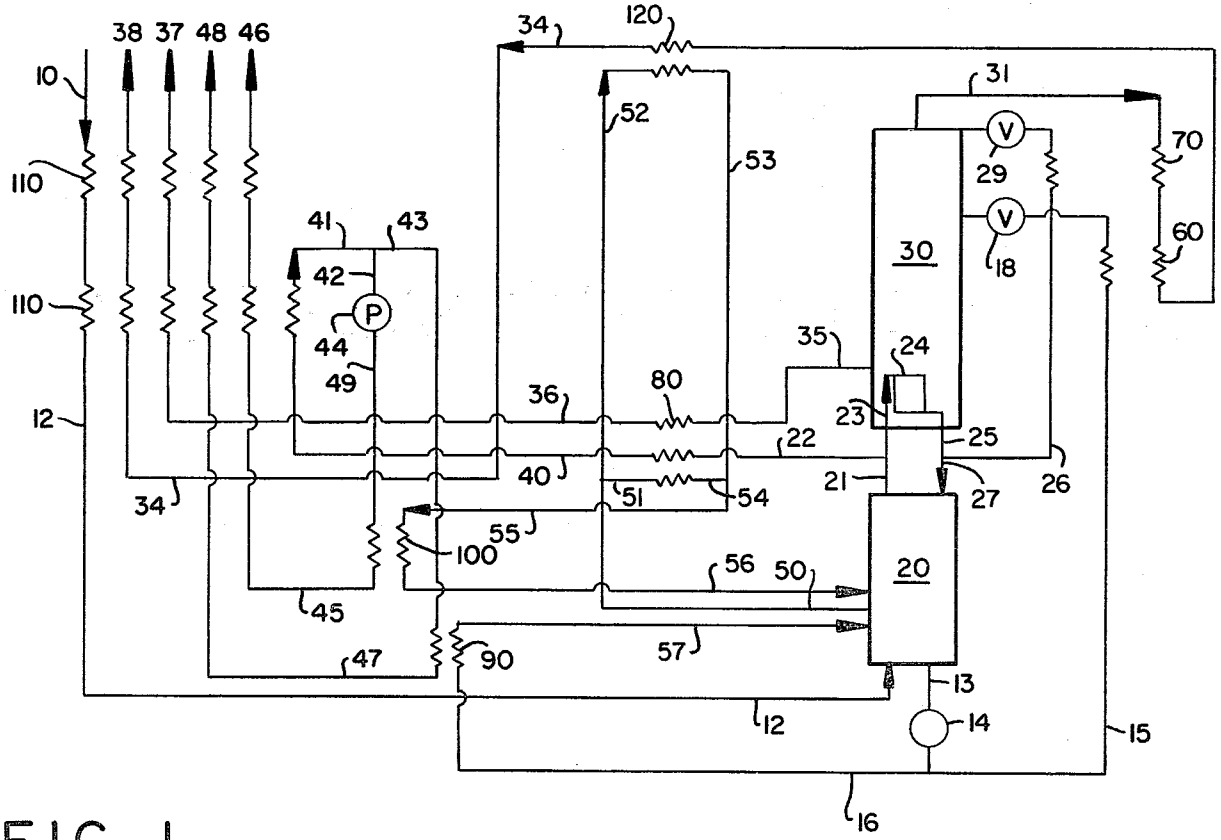
FIG. 1 is a schematic representation of one preferred embodiment of the process of this invention.

Referring now to FIG. 1, pressurized feed air 10 passes through reversing heat exchanger 110 where it is cooled and cleaned of high boiling impurities. The cleaned cooled feed air 12 is introduced into the bottom of high pressure column 20 which is operating at a pressure of from 80 to 180 psia, preferably from 90 to 120 psia. In the embodiment illustrated in FIG. 1 the high pressure column is in heat exchange relation with another column 30 operating at a pressure lower than that of the high pressure column at from about 15 to 35 psia, preferably from about 15 to 25 psia. Such a double column arrangement is well known in the cryogenic air separation art.

In the high pressure column the feed air is separated by rectification into a nitrogen-rich fraction and an oxygen-enriched fraction. The nitrogen-rich fraction, which has a nitrogen content generally greater than about 98 percent, preferably greater than about 99 percent, is removed from the top of the high pressure column as stream 21, and is divided into stream 22 which passes to the reversing heat exchanger and into stream 23 which is condensed in main condenser 24 to form condensed stream 25. This condensed stream 25 is divided into stream 27 which is returned to the high pressure column as reflux liquid, and into stream 26 which is cooled in heat exchanger 70, expanded through valve 29, and introduced into low pressure column 30 as reflux liquid.

The oxygen-enriched fraction is removed from the bottom of the high pressure column as stream 13 and cleaned of residual contaminants such as undesirable hydrocarbons or trace amounts of carbon dioxide by passage through suitable adsorbent bed 14 such as silica gel. The cleaned oxygen-enriched stream is divided into a minor part 16 and a major part 15 which is cooled in heat exchanger 60 expanded through valve 18 and introduced into low pressure column 30.

Within low pressure column 30 the two steams which are fed into the column are separated by rectification into product oxygen at the bottom of the column and waste nitrogen at the top of the column. Waste nitrogen is removed from the low pressure column 30 as stream 31, warmed by indirect heat exchange with stream 26 and stream 15 in heat exchanger 70 and 60 respectively, further heated in heat exchanger 120 and then warmed in reversing heat exchanger 110 from which it exits at essentially ambient temperature as stream 38. Product oxygen is removed from the low pressure column 30 as stream 35, heated in heat exchanger 80, warmed in reversing heat exchanger 110 and recovered at essentially ambient temperature as stream 37.

Stream 22 is heated in heat exchanger 80 and introduced as stream 40 to reversing heat exchanger 110 as the cold end unbalance stream. This cold end unbalance stream comprises from about 10 to 18 percent of the incoming feed air flow on a volumetric flowrate basis, preferably from 14 to 18 percent. The upper range for the unbalance flow is preferred since this will make available added flow which can eventually be recovered as high pressure nitrogen gas.

The cold end unbalance stream 40 will generally have a temperature of from about 94° to 96° K. The unbalance stream partially traverses heat exchanger 110, and is removed as stream 41 at a temperature of from about 140° to 190° K., preferably from about 160° to 180° K.

Warmed stream 41 is then divided into stream 42 and stream 43. Stream 42 comprises from about 50 to 90 percent of stream 41, preferably from about 70 to 90 percent. Stream 43 comprises from about 10 to 50 percent of stream 41, preferably from 10 to 30 percent. Stream 42 is turboexpanded in turbine 44, passed as stream 49 through heat exchanger 100 where it is further cooled and then passed as stream 45 to reversing heat exchanger 110 where it is warmed and exits at essentially ambient temperature as stream 46. This stream 46 may be recovered as low pressure nitrogen-rich gas. Alternatively, expanded stream 49 may be combined with waste nitrogen stream 34 and passed through the reversing heat exchanger as a combined stream. Stream 43 is cooled in heat exchanger 90 and passed as stream 47 to reversing heat exchanger 110 where it is warmed and from which it is recovered as high pressure nitrogen-rich gas stream 48 at essentially ambient temperature. The high pressure nitrogen rich gas stream 48 will have a nitrogen concentration essentially that of the nitrogen shelf vapor and a pressure essentially that at which the high pressure column is operating minus the pressure drop the flow stream experiences as it passes through the system.

To complete the process description of the embodiment illustrated in FIG. 1 the streams associated with heat exchangers 80, 90, 100 and 120 will now be described. A small stream 50 having a composition essentially that of air is withdrawn from high pressure column 20 and divided into streams 51 and 52. Stream 51 is cooled and preferably condensed, by indirect heat exchange in heat exchanger 80 with product oxygen stream 35 and shelf vapor portion 22. Stream 52 is cooled, and preferably condensed, by indirect heat exchange in heat exchanger 120 with waste nitrogen stream 34. The two cooled streams 54 and 53 are then combined into stream 55 which is passed through heat exchanger 100 where it is warmed and preferably vaporized by indirect heat exchange with stream 49 and then returned as stream 56 to high pressure column 20. Oxygen-enriched minor part 16 is passed through heat exchanger 90 where it is warmed, and preferably vaporized, by indirect heat exchange with high pressure nitrogen-rich gas 43 and then returned as stream 57 to high pressure column 20.

Thus by the process of this invention one can eliminate the mismatch between reversing heat exchanger unbalance stream requirements and plant refrigeration requirements in large cryogenic air separation plants without the need for a two-stage main condenser and also efficiently produce high-pressure nitrogen gas. Referring to the specific embodiment illustrated in FIG. 1, stream 40 has a flow rate sufficient for reversing heat exchanger unbalance stream requirements and stream 41 is divided into stream 42, which has a flow rate sufficient for plant refrigeration requirements, and into stream 43 which is eventually recovered as high pressure nitrogen gas stream 48.

Figure 2:
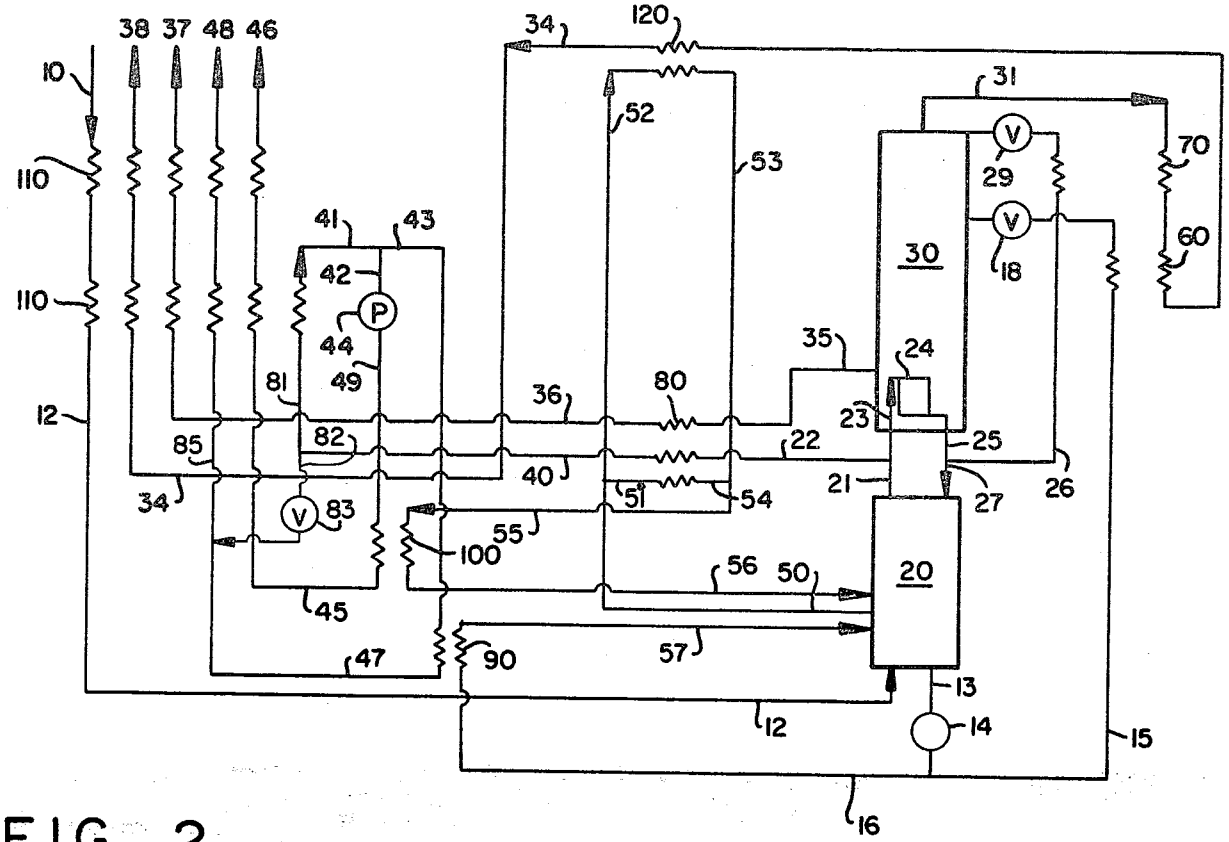
FIG. 2 is a schematic representation of another preferred embodiment of the process of this invention wherein excess shelf vapor is removed from the high pressure zone and recovered as high pressure nitrogen-rich gas.

Another embodiment of the process of this invention will be described with reference to FIG. 2. In FIG. 2 the numerals are identical to those of FIG. 1 for the common process features. As shown in FIG. 2 stream 40 is divided into streams 81 and 82. Stream 81 is equivalent to the flow required for reversing heat exchanger cold end temperature control and is from about 10 to 18 percent preferably 14 to 18 percent of the feed air flow rate. Stream 82 is added to stream 47 after undergoing expansion through valve 83 in order to compensate for the greater pressure drop experienced by the fluid in stream 47 because of the longer path it takes from the high pressure zone. Combined stream 85 is then warmed in reversing heat exchanger 110 from which it is recovered at essentially ambient temperature as high pressure nitrogen-rich gas stream 48.

Although the auxiliary heat exchanger arrangements as shown by units 80, 90, 100 and 120 in FIG. 1 are the most preferred arrangement, there are a number of other acceptable ways to effectively carry out the process of this invention. For example, expanded stream 49 could be further cooled by indirect heat exchange with the waste nitrogen stream after that stream exists heat exchanger 60. Such an arrangement could eliminate the need to use stream 50 from the high pressure column. Also high pressure nitrogen stream 43 could be cooled against feed air stream 12, or some portion of that feed air stream, and thereby eliminate the use of liquid stream 16 from the high pressure column. Also, one could, if desired, eliminate the cooling of either or both expanded stream 49 or high pressure nitrogen stream 43 prior to their introduction into reversing heat exchanger 110.

As previously mentioned, the most preferred heat exchanger arrangement is that shown, in FIG. 1. This is because each auxiliary heat exchanger involves essentially either boiling or condensing and thereby has lower heat transfer area requirements. Further, the heat exchanger arrangement of FIG. 1 tends to equate all return stream temperatures prior to introduction to reversing heat exchanger 110 thereby easing the self cleaning control requirements of heat exchanger 110.

Table 1 contains values for certain process streams obtained from a computer simulation of the process of this invention. The numerals of the process streams in Table 1 correspond to those of FIG. 1.

Although the process of this invention has been described in detail with reference to two specific embodiments, it is understood that the process of this invention encompasses many other embodiments which are within the scope of this invention as described and claimed.

TABLE I

| Stream Description | Stream No. | Value |
|---|---|---|
| Product Oxygen | 37 | |
| Flow, mcfh | | 1550 |
| Purity, percent $O_2$ | | 99.5 |
| Temperature, °K. | | 298 |
| Pressure, psia | | 19.3 |
| Feed Air | 10 | |
| Flow, mcfh | | 7693 |
| Temperature, °K. | | 302 |
| Pressure, psia | | 91 |
| Shelf Vapor Flow | 22 | |
| Flow, mcfh | | 885 |
| Percent of air flow | | 11.5 |
| Purity, ppm $O_2$ | | 3 |
| Temperature, °K. | | 96 |
| Pressure, psia | | 86 |
| Shelf Vapor Unbalance | 41 | |
| Flow, mcfh | | 885 |
| Percent of air flow | | 11.5 |
| Purity, ppm $O_2$ | | 3 |
| Temperature, °K. | | 186 |
| Pressure, psia | | 84 |
| Shelf Vapor for Refrigeration | 42 | |
| Flow, mcfh | | 745 |
| Percent of air flow | | 9.7 |
| Purity, ppm $O_2$ | | 3 |
| Turbine Inlet Temperature, °K. | 42 | 186 |
| Turbine Inlet Pressure, psia | 42 | 84 |
| Turbine Outlet Temperature, °K. | 49 | 129 |
| Turbine Outlet Pressure, psia | 49 | 18 |
| Desuperheated Turbine Exhaust Temperature, °K. | 45 | 102 |
| Shelf Vapor for Product | 43 | |
| Flow, mcfh | | 140 |
| Percent of air flow | | 1.8 |
| Purity, ppm $O_2$ | | 3 |
| Midpoint Temperature, °K. | 43 | 186 |
| Desuperheated Temperature, °K. | 47 | 102 |
| Warm End Temperature, °K. | 48 | 298 |

I claim:

1. In a process for the separation of air by rectification wherein gaseous feed air at greater than atmospheric pressure and substantially free of water and carbon dioxide is introduced into a high pressure column operating at a pressure of from about 80 to 180 psia where said feed air is separated by rectification into a nitrogen-rich fraction and an oxygen-enriched fraction, and wherein a portion of said nitrogen-rich fraction is removed from said high pressure column and warmed by indirect heat exchange with said feed air by partial traverse of a reversing heat exchange zone, said portion being sufficient to maintain self-cleaning of the reversing heat exchange zone, the improvement comprising:

(A) warming said portion comprising from about 10 to 18 percent of the feed air flow;

(B) dividing the warmed portion into a first part comprising from about 50 to 90 percent of said warmed portion and a second part comprising from about 10 to 50 percent of said warmed portion;

(C) expanding said first part to a pressure of from about 15 to 35 psia;

(D) warming the expanded first part by passage through said reversing heat exchange zone;

(E) removing from said process said first part as nitrogen-rich gas; and (F) directly recovering said second part as high pressure nitrogen-rich gas.

2. The process of claim 1 wherein said high pressure column is operating at a pressure of from about 90 to 120 psia.

3. The process of claim 1 wherein said high pressure column is in heat exchange relation with a low pressure column operating at a pressure of from about 15 to 35 psia.

4. The process of claim 1 wherein said portion of step (A) comprises from about 14 to 18 percent of the feed air flow.

5. The process of claim 1 wherein said second part is passed through said reversing exchange zone prior to recovery as high pressure nitrogen-rich gas.

6. The process of claim 1 wherein said second part is cooled by indirect heat exchange with a high pressure oxygen-enriched stream prior to recovery as high pressure nitrogen-rich gas.

7. The process of claim 1 wherein said second part is cooled by indirect heat exchange with incoming feed air prior to recovery as high pressure nitrogen-rich gas.

8. The process of claim 1 wherein a second portion of nitrogen-rich fraction is removed from said high pressure zone passed through said reversing heat exchange zone and recovered as high pressure nitrogen-rich gas.

9. The process of claim 1 wherein said expanded first part is further cooled prior to warming by indirect heat exchange with a high pressure stream having a composition essentially that of air.

10. The process of claim 1 wherein said expanded first part is further cooled prior to warming by indirect heat exchange with a nitrogen-rich waste stream.

11. The process of claim 1 wherein said expanded first part is combined with a nitrogen-rich waste stream prior to warming.

12. The process of claim 1 wherein at least a portion of the warmed expanded first part of step (D) is recovered as low pressure nitrogen-rich gas.

13. The process of claim 1 wherein said first part comprises from about 70 to 90 percent of said warmed portion and said second part comprises from about 10 to 30 percent of said warmed portion.

* * * * *